US007273006B2

(12) United States Patent
Rasmussen et al.

(10) Patent No.: US 7,273,006 B2
(45) Date of Patent: Sep. 25, 2007

(54) METHOD FOR EMBOSSING CONTAINER WALLS

(75) Inventors: Robert C. Rasmussen, Berlin, NJ (US); Steven N. David, Sicklerville, NJ (US)

(73) Assignee: Wastequip, Inc., Cleveland, OH (US)

( * ) Notice: Subject to any disclaimer, the term of this patent is extended or adjusted under 35 U.S.C. 154(b) by 263 days.

(21) Appl. No.: 10/679,655

(22) Filed: Oct. 6, 2003

(65) Prior Publication Data

US 2005/0071980 A1 Apr. 7, 2005

(51) Int. Cl.
*B44C 1/24* (2006.01)

(52) U.S. Cl. ..... 101/32; 101/4; 101/28

(58) Field of Classification Search ..... 101/3.1, 101/4, 9, 18, 21, 27, 28, 31.1, 32; 72/414, 72/447

See application file for complete search history.

(56) References Cited

U.S. PATENT DOCUMENTS

| | | | | |
|---|---|---|---|---|
| 21,473 | A * | 9/1858 | Storm | 101/4 |
| 926,271 | A * | 6/1909 | Matthews | 101/3.1 |
| 1,487,899 | A * | 3/1924 | Sturges et al. | 101/7 |
| 1,527,091 | A * | 2/1925 | Snow | 101/7 |
| 3,815,493 | A * | 6/1974 | Broderick | 101/6 |
| 4,342,402 | A | 8/1982 | Jungles | |
| 5,129,543 | A | 7/1992 | White | |
| 5,372,269 | A | 12/1994 | Sutten et al. | |
| 6,135,022 | A | 10/2000 | Troester | |
| 6,267,260 | B1 | 7/2001 | Lyons | |
| 6,364,106 | B1 | 4/2002 | Fagg et al. | |
| 2002/0006107 | A1 * | 1/2002 | Kikuchi | 369/291 |

FOREIGN PATENT DOCUMENTS

| | | | |
|---|---|---|---|
| DE | 200985 | A * | 6/1983 |

* cited by examiner

*Primary Examiner*—Leslie J Evanisko
(74) *Attorney, Agent, or Firm*—Duane Morris LLP

(57) ABSTRACT

A method and apparatus for embossing the sidewalls of heavy gauge sheet metal containers involves clamping over a top edge of an opening into the container using a press carrying complementary embossing dies. The clamping apparatus can be a portable punch press having opposite members on a solid C-shaped frame, one being movable by a hydraulic drive cylinder to bear against the other. The die set coupled to the clamping apparatus has opposite protrusions and depressions representing an indicia to be embossed on the container, such as a trademark, symbol, owner's name or other indicia. In one embodiment the container is a dumping refuse container with an opening edge reinforced by a frame. The press has an opening throat that spaces the dies sufficiently that the clamping apparatus can be clamped over the reinforced edge to space the point of deformation of the sheet metal from the edge of the opening. The die set can form raised characters, a bas relief or another shape, the disclosed example being an externally raised logo, e.g., about 0.125 inch high and formed over an area of about four by seven inches using a 50 ton press.

7 Claims, 4 Drawing Sheets

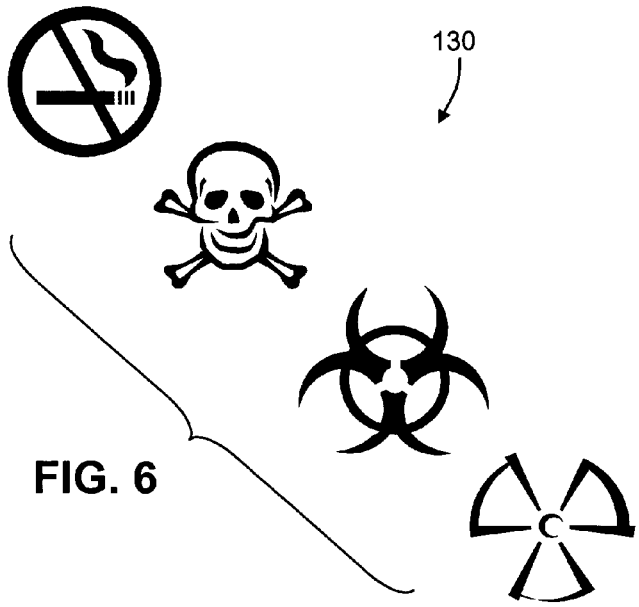
FIG. 6
FIG. 7
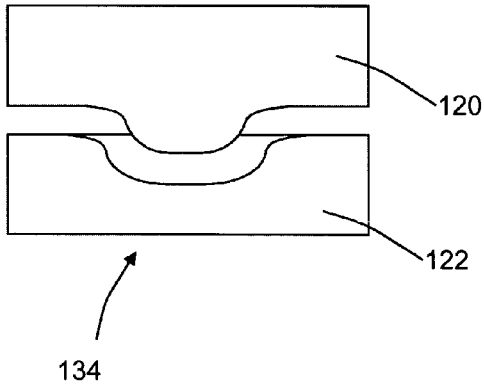
FIG. 8
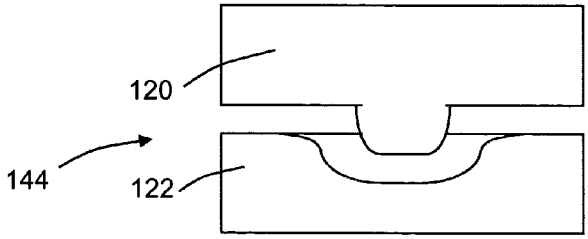

METHOD FOR EMBOSSING CONTAINER WALLS

BACKGROUND OF THE INVENTION

The invention relates to metalworking steps applied to substantially finished heavy gauge sheet steel products, and an apparatus to accomplish such steps.

An hydraulic press with complementary dies shaped to form raised or bas-relief letters, logo symbols, shapes or similar indicia, is provided on a movable carrier and used to clamp around a reinforced free edge and to emboss an outer wall of a finished container, such as a dumping refuse container, roll-off container, intermodal refuse container or other heavy gauge container.

PRIOR ART

It can be desirable for various reasons to mark a container such as a dumping refuse container (sometimes termed a "dumpster"), a roll-off container or heavy duty shipping container. The content of the indicia labeling the container could refer to an enterprise such as the container owner or manufacturer, a user such as an apartment complex, or a service company contracted to empty the container periodically. The indicia could identify the container itself, for example as a serial number used in asset tracking of the containers or in connection with metering the number of times a container is emptied, for billing purposes. Containers could also be labeled for informational purposes, such as to distinguish a recycling container from a refuse container.

Where labeling is used at all, heavy duty containers such as dumpsters are usually labeled by painting or are provided with small sheet metal label panels that are adhesively affixed, riveted or bolted, or may be attached by welding. Labels may be larger or smaller, more or less elaborate, and more or less detachable, depending on their intended function. Indicia applied by a business to distinguish its containers from others in an alley might be painted differently or stenciled crudely with a business name. An identifier such as a serial number that is critical for billing purposes must be unique and difficult to obscure or alter. Serial number plates therefore are stamped with plural changeable digits reflecting some remotely stored information in a database and are relatively permanently attached, for example by welding the label plate to the container.

Welding is appropriate for heavy gauge metal containers, but the use of welding equipment, cutting torches and the like, whether to apply or to remove a label plate or even to form characters by directly forming lines and shapes, is much more likely to damage to the container, sometimes requiring grinding to smooth surfaces, and almost always requiring repainting to reduce the incidence of corrosion.

Although welding may be appropriate, painting to place indicia on containers has some deficiencies due to the heavy duty nature of the container. If a container is handled roughly, e.g., when moved about, filled, lifted for dumping, etc., painted surfaces can be worn or obscured.

It would be advantageous to provide a labeling technique that is durable and attractive, and more permanent than painting or attaching a potentially detachable label plate that might be altered or replaced in a manner difficult to detect.

It is known in connection with certain light gauge sheet metal structures to imprint identifications in the form of manufacturers' logos, when the sheet metal structures are being stamped out prior to assembly. One example is the forming of vehicle manufacturer logos in stamped pickup truck tailgates, simultaneously with the stamping of bends that lend to the stiffness of the structure. The walls of heavy gauge containers, however, are not readily stiffened in that way. Walls of containers such as dumpsters are cut from flat sheets, for example in seven or ten gauge steel plate, and welded at the junctions. Thick material is needed for necessary structural strength, and the thickness of the material is such that if any curvature is to be provided, it is limited to long radius bends, such as to provide a curved bottom surface with a low point for a drain hole.

Additionally, heavy containers are provided with reinforcements, particularly at the perimeter of the top opening of the container, where particularly rough treatment is likely. The perimeter of the top of a container may have plural welded thicknesses of material or a frame of tubing may extend along the free edges of the walls at the top or other opening, e.g., heavy rectangular cross-section tubing to which the wall panels are welded. These reinforcements are structured and intended to prevent bending and flexing of the side walls.

It would improve a container of the type described, if a label such as a logo or name or perhaps a symbol or instructional indicia could be formed directly in an external part of the container conveniently and without risking damage to the container, even though the container side wall may be a heavy gauge steel with framing reinforcements. It would generally be advantageous to improve the way in which identifying indicia is provided on heavy gauge containers such as dumpsters and roll-off containers, namely without the drawbacks associated with painted labels and attached label plates.

SUMMARY OF THE INVENTION

A technique is provided for labeling heavy gauge sheet metal structures that can be effected after the structures are substantially built, e.g., to mark already-primed dumping refuse containers ("dumpsters"), by embossing or impressing a logo or similar indicia in a front or side wall along the front or side of a top opening using a clamping press with associated complementary die members that can be manipulated over an edge of a container opening.

According to one aspect, the marking or labeling device and method do not mar the container, although a raised/depressed embossment is established, and thus can be used after the marked wall has been painted or at least primed for finish painting.

According to another aspect, a durable and visually appealing embossment is provided for marking refuse containers that are to be subjected to rough handling, the marking being more permanent and less subject to damage than a painted or adhesively attached label.

According to a further aspect, the invention facilitates customized marking of refuse containers, roll-off containers, intermodal containers and other heavy gauge container products, with respect to identification of suppliers or owners or users, alternatively to announce container content warnings, or even to provide decoration.

More particularly, a method and apparatus for embossing the sidewalls of heavy gauge sheet metal containers involves clamping over a top edge of an opening into the container using a press carrying complementary embossing dies. The clamping apparatus can be a portable punch press having opposite members on a solid C-shaped frame, one being movable by a hydraulic drive cylinder to bear against the other. The die set coupled to the clamping apparatus has opposite protrusions and depressions representing an indicia to be embossed on the container, such as a trademark, symbol, owner's name or other indicia. In one embodiment the container is a dumping refuse container with an opening edge reinforced by a frame. The press has an opening throat that spaces the dies sufficiently that the clamping apparatus can be clamped over the reinforced edge to space the point of deformation of the sheet metal from the edge of the opening. The die set can form raised characters, a bas relief or another shape, the disclosed example being an externally raised logo, e.g., about 0.125 inch high and formed over an area of about four by seven inches using a 50 ton press. Other sizes and/or pressures are also possible.

BRIEF DESCRIPTION OF THE DRAWINGS

The foregoing features and advantages of the invention, as well as other aspects and routine extensions of the invention, are apparent from the following detailed description of examples and preferred embodiments, to be considered together with the accompanying drawings, wherein the same reference numbers have been used throughout to refer to the same functioning parts, and wherein:

FIG. 6 is a plan view illustrating alternative types of subject matter for the embossed indicia.

FIG. 7 is a partly sectional view illustrating an embossing die set with form fitting complementary members.

FIG. 8 is a partly sectional view as in FIG. 7, but having die set members that are not fully complementary.

DETAILED DESCRIPTION

A number of exemplary embodiments of the invention are described herein with reference to the drawings. These embodiments are examples intended to demonstrate aspects of the invention in different forms or separately. Not all the aspects are required in all embodiments of the invention, and the illustrated embodiments should be regarded as exemplary rather than limiting.

Figure 1:
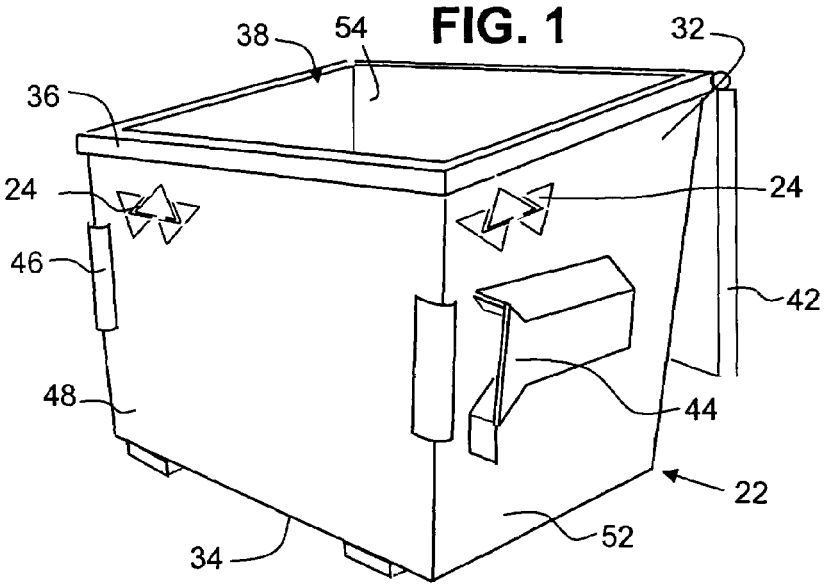
FIG. 1 is a perspective view showing a finished dumping container (sometimes called a "dumpster") bearing an embossed logo according to the present invention.

Referring to FIG. 1, a container 22 such as a heavy gauge steel plate dumping container or dumpster, is marked with an indicia 24 that is raised from a plane of the steel plate, or depressed inwardly from the plane as a bas-relief. As suggested by the example, the indicia 24 can represent a logo such as a stylized letter formed by geometric shapes. The specific form of the indicia and the content or information that the indicia represents (if any) are subject to variation.

The indicia 24 is formed or embossed directly in a sheet metal sidewall plate 32 of container 22, for example near an edge or corner, by a high pressure metal deformation technique that preferably is accomplished after container 22 has been substantially constructed. In this context, the embossing is construed to involve a metal drawing step as opposed to coining or stamping by impact. The indicia is formed by pressing a distinct raised (or depressed) shape at a limited area of an otherwise substantially planar part of the metal plate or sheet making up the sidewall of the container. The shape is permanently established in that one or more discrete areas in the sheet are pulled or stretched (drawn) to diverge from the plane of the original material. The process substantially maintains the original thickness of the material, but for incidental thinning due to the stretching or drawing of the metal. The result is one or more distinctly shaped dents or bulges, presented in positive and negative form on opposite faces of the sidewall, in one or both directions, to provide a permanent raised or depressed embossment in that shape.

The exemplary container 22 as shown is constructed as a collection of heavy sheet steel plates, with frame parts and attachments comprising tubing or angle-iron. These parts are welded to one another to form the container. The container is expected to endure rough handling in being loaded and unloaded, the latter involving engagement with lifting mechanism (not shown) whereby the container is inclined and dumped.

The illustrated container 22 consists essentially of a set of plate steel sheets or panels defining a bottom 34 and four more or less vertical sides for the front 48, lateral sides 52 and rear 54. The container is reinforced by a frame of rectangular tubing 36 around the top or opening edge 38, which stiffens the container shape and provides a place to secure a hinge for a lid 42. Similar frame elements, comprising lengths of tubing or angle-iron can be provided along the edges and/or corners where the sidewall panels 32 meet one another and the bottom, e.g., as skeleton members framing or reinforcing the container.

The wall panel plates 32 that define the body parts of the container 22 are typically cut and welded from straight or flat stock. It is also possible to employ variations, such as rounded bottom or side configurations, body structures wherein adjacent sides are folded integrally to form right angles instead of welded, etc. However according to the invention, an area to be embossed is provided at which an unobstructed area of at least one panel 32 is available to be engaged by a movable embossing press. The unobstructed area preferably is flat but could conceivably be curved.

The rectangular tubing 36 reinforces the top or opening edge of the container and provides important structural support and stiffness. As a result, the unobstructed surfaces of the sidewall plate or plates 32 are spaced downward from the lip or opening edge of container 22, where the plates 32 are attached to the tubing 36 by welds (see also FIG. 5).

The container 22 in the example is the dumpster type, intended to be lifted and/or tilted to dump into a collection truck (not shown) by means of tine receptacles 44 along the lateral side walls 52. Tine receptacles or channels also can be provided on the bottom 34 for engagement using a forklift type truck (not shown). In the embodiment shown, two bumpers 46 are provided to protect the container body at the front, and in the area of the inlets to the tine receptacles 44.

The container 22 shown in FIG. 1 is intended as illustrative of a class of heavy gauge containers that have plate steel areas in which the wall panels advantageously can receive an embossment such as a logo or the like, after the container 22 has been substantially constructed. The front-access dumping container shown in FIG. 1 is a relatively small member of the family of such containers, the individual members of which are in wide use. The family also includes other and substantially larger versions of tilting and dumping containers, some having tine receptacles on the side or bottom, box-like containers that have intermediate rib structures comprising tubing frames or bar stock, e.g., between the edges at which the sides are joined, heavy roll-on roll-off containers as used, for example, at construction sites, intermodal containers, vacuum capable units, compactor bodies, etc. The invention is applicable to embossing these and various containers that have unobstructed sheet areas as constructed, in an area accessible to a movable embossing press as described herein.

According to the different embodiments of such containers, the sidewalls panels 32 typically comprise seven to twelve gauge steel sheet, typically ten or twelve gauge steel sheet for the sort of container shown in FIG. 1. The construction steps for building the container generally involve clamping flat wall panels 32, reinforcing tubing 36 and other parts into position, for example using a standardizing support structure or jig, and affixing welds to join the parts where they meet one another, either along continuous lines or spaced spot welds.

It might be possible to form heavy containers such as dumpster containers using metal draw techniques, but a press to accomplish that would be quite large in view of the thickness and weight of the component materials, i.e., the steel plate. Furthermore, it would still be necessary to reinforce the container, particularly around the rim or perimeter of the opening into the container. As a result, the practical way to build the containers is to cut and weld flat sheets, with possible reinforcing plate, bar, angle iron or channel material. In the embodiment shown in FIG. 1, only the bumpers 46 were cut from curved stock or were shaped by metal deformation steps.

According to the invention, an at least partly assembled container 22 is to be embossed with indicia 24 by locally drawing a section of the plate steel using embossing dies with complementary projections and depressions, to displace the steel from its plane in one or both directions perpendicular to the plane. The dies are applied at a clear portion of the sidewall plate 32, spaced from the opening edge 38 and clear of the reinforcing tubing 36.

The indicia shown in FIG. 1 can represent a manufacturer's logo (such as a stylized letter or a symbol). The content of the indicia can vary as appropriate. For example, the indicia can represent a supplier of waste management services, the owner or user of the container, an organization or business entity somehow associated such as a residential organization or the like. The indicia can be unrelated to businesses, for example being informational. For example, a warning symbol can be applied to containers used for hazardous or inflammable contents.

The indicia 24 is embossed after the container is substantially constructed. Accordingly, the invention concerns the process of making the embossed container as well as the product made by the process. A finished or nearly finished container 22 is built, and can be at least primed for painting before the indicia 24 is embossed. The embossing comprises clamping the steel plate wall portion 32 that will bear the indicia, between die set members with sufficient pressure to deform the wall so as to permanently draw the plate and impress the indicia into the panel, forming indicia as raised and/or depressed shapes, straight or curved ridges and valleys, point-wise depressions and peaks, etc., but generally doing so by drawing the material as opposed to coining or thinning the material by impact. As a result, positive and negative versions of indicia 24 are formed on opposite sides of the sheet metal sidewall panel 32.

Figure 3:
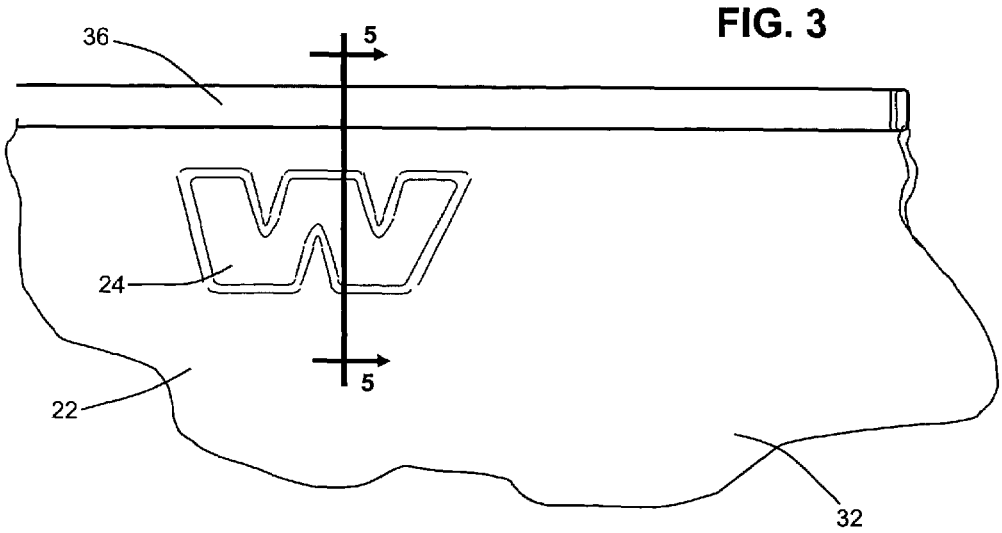
FIG. 3 is a partial elevation view showing an embossment adjacent to an opening of a container.

As shown in FIGS. 1 and 3, the indicia 24 is applied to the side wall panel 32 at a point that is spaced from the free edge 38, especially spaced from any unsupported free edge 38 at the opening, so as to avoid the possibility of producing a bend that extends into and deforms the edge of the opening. The spacing that is needed from a free edge varies with the dimensions of the wall panel material (especially thickness) and the character of the embossed indicia. Relatively more spacing is needed, for example, if the indicia contains a deep ridge that is elongated perpendicular to the edge of a panel where the edge is unsupported, because embossing could cause a crease at the edge. In the embodiment shown in FIGS. 1 and 3, the indicia is applied near edge 38, for example at a distance of one to three inches, and the edge is reinforced by rectangular tubing 38 to which the wall panel 32 is welded, at least at spaced points and optionally along a continuous line. The indicia forms an area of about 2.5 inches height and 8 inches width, although this is variable. The indicia 24 is embossed to a depth that is comparable to the thickness of the material of the panel 32.

According to the inventive technique, a first step is to build or provide the container 22. The container has walls 48, 52, 54 at plural sides, and can be in a substantially finished state as shown in FIG. 1. The respective walls of the container include at least one external panel 32 to be embossed. For example the front vertical wall 48 or one or both lateral sidewalls 52 can be embossed as in the embodiment shown in FIG. 1. The rear wall is a candidate for embossing, but it may be necessary to remove the lid to obtain the necessary access to clamp the embossing dies in place. The wall panel to be embossed has a predetermined thickness of sheet metal, such as 10 or 12 gauge steel, for example, and is disposed as an exterior panel having an area that is accessible on both sides from the edge or opening 38 into the container. In this way, the embossing dies can readily be placed opposite from one another on opposite sides of the panel by placing an embossing clamping tool onto the side wall near an edge of the opening.

Figure 2:
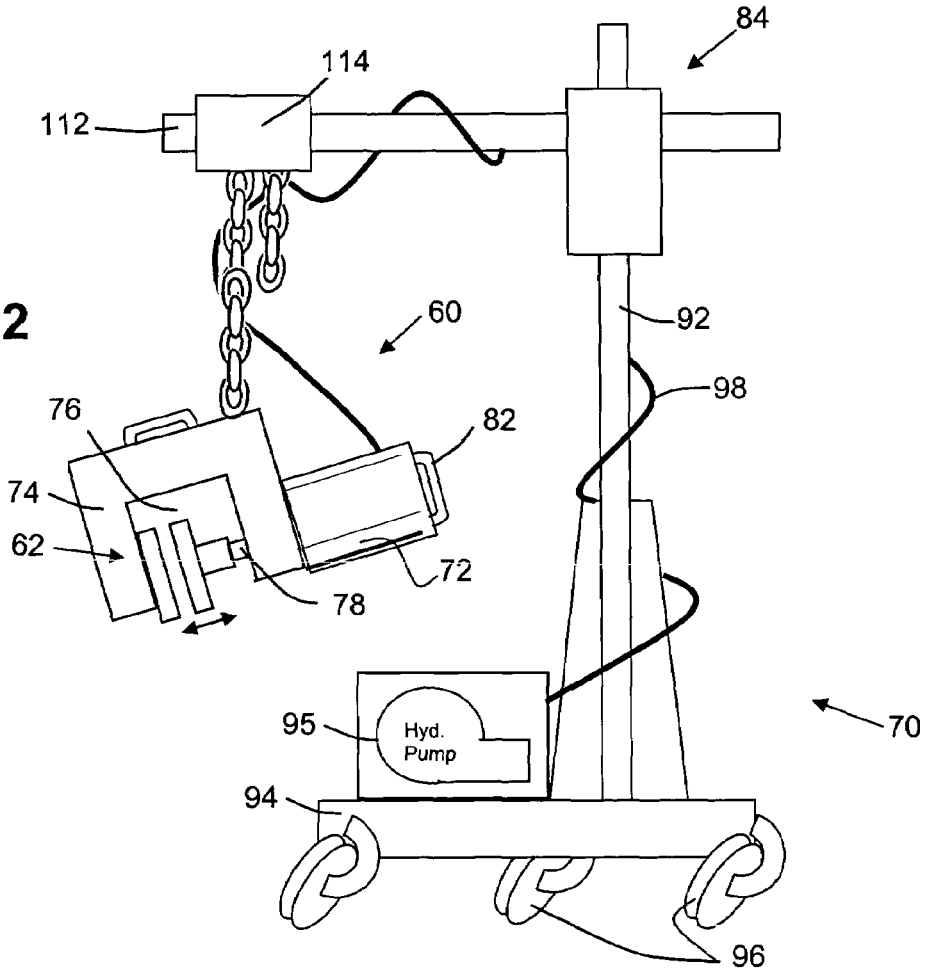
FIG. 2 is an elevation view illustrating a portable embosser according to the invention.

An exemplary embossing clamping tool 60 is shown in FIG. 2. The tool 60 is structured in some respects like a bench mounted hydraulic punch press, but is configured to be movable and subject to manipulation for positioning and operation. The embossing clamping tool 60 carries a die set 62 wherein the opposite members have at least partly complementary protrusions and depressions. These are discussed in more detail below. The two complementary members of die set 62 are mounted, preferably removably, on clamping tool 60, and tool 60 is carried on a movable support apparatus 70 by which the tool 60 is brought to bear to apply the die set members to opposite sides of plate 32 with sufficient pressure to deform the metal sheet and to draw the sheet to assume the shape of the protrusions and depressions.

In FIG. 2 an exemplary mobile apparatus 70 for applying the die set 62 to the metal sheet 32 of the container side wall carries the clamping tool 60 in a suspended manner. The tool part 60 has a hydraulic cylinder 72 or similar force applying device, mounted on a housing structure 74 that is C-shaped and spaces the members of the die set 62 so as to allow the die set members to be brought together under pressure from opposite sides of the container wall panel 32. The housing 74 and the mounting particulars for the die set 62 and hydraulic cylinder 72 provide for a throat 76 with spacing and clearance adjacent to and between the die set members when retracted. The spacing is sufficient to enable the die set pair to be manipulated over the edge 38 of the container opening, and placed at the accessible zone or area to be embossed, i.e., as close to the edge as possible given the size and shape of the C-shaped structure 74.

The hydraulic cylinder 72 in the embodiment shown in FIG. 2 is mounted on one end of the substantially C-shaped solid housing configuration and carries one of the members of die set 62 on a movable cylinder shaft 78. The other of the die set members is mounted on the other arm of the C-shaped configuration 74 and is stationary. The tool 60 preferably is carried on a winch that substantially balances the press tool, and also has one or more handles 82 arranged so the tool can be manipulated by a user and associated controls for powering the press from a hydraulic pump.

After positioning the press tool 60, the user activates the power source that operates cylinder 72 and applies inward pressure between the opposite die set members 62. The side wall material (see also FIG. 1) is thereby embossed or deformed by drawing, to leave the impression of the indicia 24, substantially matching on opposite sides of plate 32 the shapes of the facing surfaces of the die set members 62. The result is a visible image of the members of the die set, such as a logo as in FIG. 1, or as an informational message, and identification, warning, decoration or the like, or another similarly beneficial indicia.

According to an inventive aspect, the press that locally forms the indicia 24 is brought to a constructed container 22. A mobile jib crane 84, for example as shown in FIG. 2, is preferably wheeled to the container to bring the clamping press into position. The jib crane 84 has a vertical post 92 on a chassis 94 with rollers or casters 96. The chassis can carry a hydraulic pump 95 to power the cylinder 72 of the press through hydraulic hoses 98. Alternatively, the power source for the press cylinder can be located nearby.

In the embodiment shown, the jib crane 84 has a laterally extending spar 112, which can be horizontal or inclined. The spar 112 is affixed to the post or mast 92 of the crane so that the spar is vertically movable and fixable, for example by means of a lateral fixing pin (not show) at a height that is convenient to the operation. In turn, the spar 112 carries a traveling winch 114, a chain variety being shown, for lifting and lowering the mobile clamping tool 60 containing the die set 62, the C-shaped mounting configuration 74 with spacing to grasp around the edge 38, the hydraulic cylinder 72 that drives the die set members toward (and preferably also away) from one another, and such handles and controls as needed in manually manipulating, placing, holding and activating tool 60.

In one embodiment, the press contains a hydraulic punch press such as a 50 ton Enerpac hydraulic press. The press can be of a type normally employed as a bench mounted unit. This unit has a very substantial solid steel C-shaped body portion defining a throat or opening width of about eight inches. This distance is sufficient to span around the rectangular tubing 36 reinforcement at the container edge 38 (typically about two inches wide) while the die set members 62 are mounted on the press, and a sufficient stroke to bring the die set members into forceful engagement on opposite sides of the container wall.

The 50 ton press is driven with a 10K psi multiple stage hydraulic pump, with air-over-hydraulic operational modes, thereby avoiding electrical motors, power supplies and potentially dangerous electrical arcs. For example, a pneumatically driven hydraulic pump such as the Enerpac PAM series pump can power the press. The press preferably uses the two speed power-in/power-out mode of operation so as to close quickly on the panel or to be retracted quickly after operation, the slower speed being employed when pressure on the die sets builds during the metal-drawing embossing process. The press has about a ten second cycle time to close, engage, release and retract.

Figure 4:
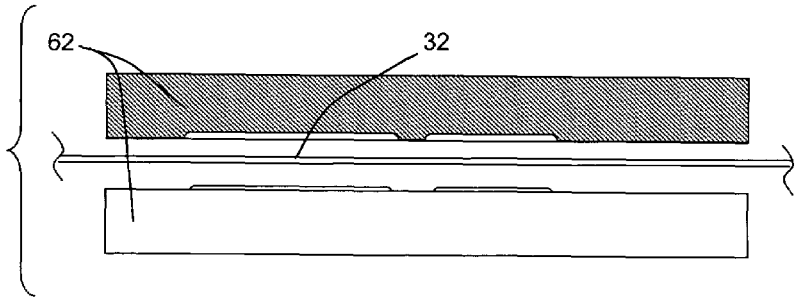
FIG. 4 is an elevation view, partly in section, showing an embossment die set.
Figure 5:
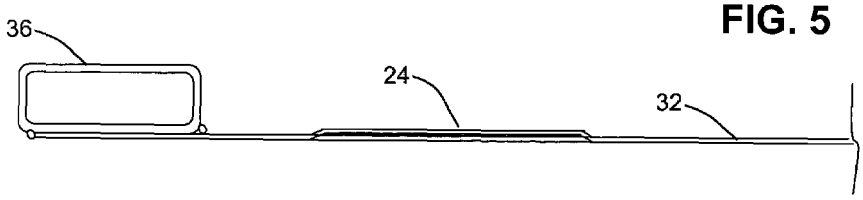
FIG. 5 is a sectional view taken along lines 5-5 in FIG. 3.

The die set 62 has complementary positive and negative forms of at least one shape to be formed as the indicia 24. The shape is made as a raised design or as a bas-relief (depressed design) or as a combination of raised and depressed areas. FIGS. 3-5 show details of an exemplary embossed indicia 24. The letter or initial is shown as a non-limiting example. The initial is provided by drawing the metal to raise the body of the letter from the plane of the wall, and/or relatively lowering the perimeter areas, with a substantially rounded over or inclined outside edges around the character(s). Other sorts of identifying indicia might identify by name or symbol or other indicia, a manufacturer, supplier, establishment, owner, township, service provider, etc. The indicia can include one or several initials or shapes, a name, or other content. FIG. 6 illustrates another possibility, namely embossing warning symbols 130 to identify containers that might hold poisons, biohazards, flammable materials, radiation danger or the like.

FIG. 4 shows a rounded edge complementary contour for die set members 62. Round and inclined edges are preferred over sharp corners, which can be difficult to draw in an embossing technique as described. Furthermore, raised characters or shapes with rounded or chamfered (inclined) edges are preferred for the indicia because the indicia normally can be formed without marring even a painted or at least primed surface. Rounded edges lack places where dirt and moisture can adhere. The rounded form is also attractive and gives an impression of solidness. The rounded form can be achieved in different ways using complementary die set members.

In FIG. 4, two simple die set members are illustrated. As shown, one of the die set members 120 has exclusively raised or positive shapes. The other 122 has exclusively depressions or negative shapes. As stated above, it is also possible to mix positive and negative shapes such that portions of the indicia are raised or lowered from the plane of the sheet material on both sides.

The two die set member in FIG. 4 are both exactly complementary to the desired shape on opposite sides of the sheet material. When pressed together over the sidewall, the die set produces the indicia shown in elevation in FIG. 3 and in section in FIG. 5. The depth can be more or less, but it has been found that a good indicia image is obtained in 10 to 12 gauge steel plate if raised to about one eighth inch (0.125 inch) or slightly more than the thickness of the steel plate. In the embodiment of FIG. 3, the logo measured about eight inches in width, about 2.5 inches in height and is drawing to a level 0.125 inches above the surface plane of the wall panel.

One concern in connection with the press is keeping the die set members 62 in accurate alignment, particularly because the hydraulic cylinder shaft 78 is cylindrical. This presents a challenge because the die set members are mounted on the relatively movable parts of the clamping fixture, and placing them includes reaching the clamping fixture over the opening edge of the container to locate the members of the die set over the accessible area on said opposite sides where the embossment is to be made. Thus it is not possible to employ locating pins or similar guides extending between the opposite die set members 62. Nevertheless, the solid C-shaped body configuration of the press as shown in FIG. 2 is such that there is little possibility of relative movement of the die member on the stationary side. Locating pins (not shown) can be provided to fix the relative positions of the die set member to the body configuration on the movable side with the cylinder. It is potentially possible to have both die set members be movable to apply inward pressure for embossing the indicia onto the steel plate or sheet of the container side wall, for example using a caliper arrangement or the like.

FIGS. 7 and 8 further show two possibilities for complementary shapes to be provided as the die set members, which are more or less complementary. In FIG. 7, the positive and negative shapes 120, 122 are spaced by a gap of continuous thickness when the die set members are engaged, thus substantially forming the plate steel sheet of the container wall into the identical shapes of the die set members. In short, the die set 134 in FIG. 7 is an exact image set having the same contour in positive and negative shapes on the respective die set members, except a constant clearance or gap is provided to account for the thickness of the sheet in the fully-closed drawn position of the respective parts. By comparison, FIG. 8 shows a die set 144 in which the gap between the positive and negative shapes is not of a particular width. The embodiment in FIG. 8 nevertheless can draw an indicia as shown in FIGS. 1 or 3.

Figure 9:
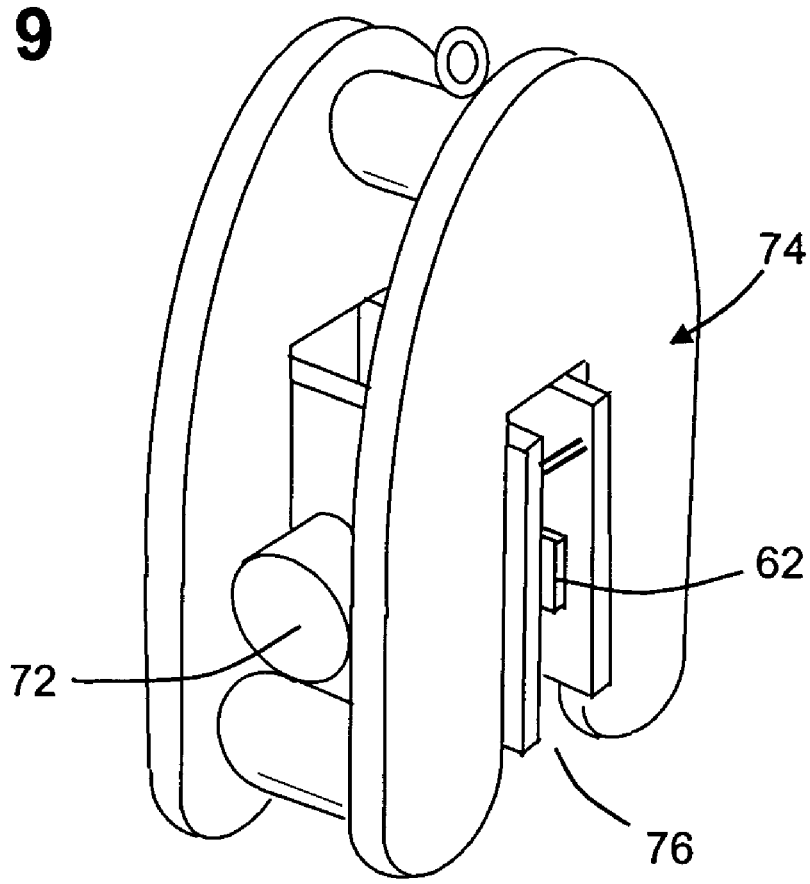
FIG. 9 is an isometric view of a heavy duty embossing tool head according to a practical embodiment.

In FIG. 9, a heavy duty embossing tool head according to a practical embodiment, has two heavy C-shaped plates coupled by welded tubes, forming the C-shaped housing 74 with throat 76 that can extend over the edge of a container to bring the members of die set 62 into position. In this embodiment, the hydraulic cylinder 72 is mounted on one of two support plates on opposite sides of the opening 76 into the C-shaped structure 74.

The invention is not limited to the method disclosed, but also extends to the apparatus for embossing containers as shown especially in FIG. 2. This apparatus 70 comprises a press 60 for marking heavy gauge containers having at least one external panel 32 of a predetermined thickness of sheet metal, which panel is accessible from an opening 38 into the container such that the clamping device or press 60 can be brought to bear.

The clamping apparatus has opposite members 62 and a forcible drive 72 operable relatively to move the opposite members, i.e., to bring them together, not so much to stamp and coin the plate steel but instead to apply a molding pressure to emboss the plate steel with raised and/or depressed areas that define an indicia. The die set coupled to the clamping apparatus has at least two opposite dies containing complementary protrusions and depressions representing the indicia to be embossed onto the container wall, the dies being movable to bear toward one another by operation of the forcible drive, in particular a hydraulic press capable of exerting 20 to 70 tons pressure, and preferably about 50 tons.

The forcible drive comprises a portable type hydraulic press mounted on a frame 74. However, according to an inventive aspect, the press is truly portable in that it can be positioned using the movable carriage, post and jib boom arrangements as shown in FIG. 2, to bring the press into operative position during application of embossing pressure to draw the form of the indicia in an accessible area of the container wall panel.

For this purpose, the press is movably supported on a carriage that permits the press to be translated, raised, lowered and manually aligned by appropriate supports and handles, optionally have power assists. The press has a throat or opening between the points at which the die set members are mounted that permits the press to be engaged over the edge of the container to apply the die set members at least at a slight space away from a free edge of the wall panel to be embossed. The throat spaces the dies sufficiently that the clamping apparatus can be passed over an edge of the opening of the container, including any reinforcing tubing, channel or angle iron, for applied in the dies set on opposite sides of the sheet metal at a position adjacent to the opening members of the die set on the external wall panel.

As described, the members of the die set carried on the press have complementary positive and negative forms of at least one shape to be formed into one of a raised design and a bas-relief representing one of a name and a symbol associated with one of a manufacturer, supplier, establishment, owner and service provider or another similar indicia.

The clamping apparatus can be sized for placement over a wall of a refuse container such as a dumpster, roll-off container, intermodal container or the like. Preferably the clamping press has a throat the is sized to pass around the opening of such a container if reinforced by a channel frame. The hydraulic press is powered sufficiently to deform sheet steel of between twelve gauge and seven gauge thickness to a displacement of one-eighth inch from a plane on both sides of a wall of the container. Alternatively, the device should deform the plate to a height and/or depth that is at least equal to the thickness of the plate, and preferably slightly exceeds such thickness.

For positioning, the apparatus has a positioning support for the hydraulic press, comprising appropriate supports and movable supports such as a wheeled carriage on casters or rollers, a supporting base, a mast or post and jib boom having one or more movable carriages, a lifting/;lowering winch and appropriate manual handles and/or powered controls.

According to a further aspect, the invention is the product formed by the process as described. The product is a container formed with a drawn embossed indicia applied by clamping complementary members of a die set reflecting the indicia, over the panel 32 of a previously constructed container, but for said indicia.

The invention is not limited to the particular constructions herein disclosed and shown in the drawings, but also comprises any modifications or equivalents within the scope of the appended claims.

What is claimed is:

1. A method for marking containers, comprising the steps of:

providing an at least partly assembled container having container walls at plural sides of the container and a closed bottom, in a substantially finished state, the container walls having an edge defining an opening into the container and including at least one external panel of a predetermined thickness of sheet metal, the external panel having an area that is accessible from said opening into the container;

providing a clamping fixture comprising a die set, said die set comprising at least partly complementary protrusions and depressions on respectively opposite members of the die set;

reaching said clamping fixture across said edge and into said opening so as to place the members of the die set on opposite sides of the external panel at said accessible area;

clamping said clamping fixture across said edge; and applying inward pressure between the opposite members sufficient to emboss a visible image of the members of the die set on the external panel.

2. The method of claim 1, wherein the members of the die set have complementary positive and negative forms of at least one shape to be formed into one of a raised design and a bas-relief.

3. The method of claim 2, wherein the members of the die set form indicia representing one of a name and a symbol associated with one of a manufacturer, supplier, establishment, owner and service provider.

4. The method of claim 1, wherein the inward pressure is applied using a hydraulic press having relatively movable parts each carrying one of the members of the die set, and wherein said relatively movable parts are carried on said clamping fixture.

5. The method of claim 1, wherein the inward pressure is applied using a portable hydraulic press on a movable carrier, and further comprising manipulating a position of the portable hydraulic press to place the members of the die set before applying the inward pressure.

6. The method of claim 1, wherein the clamping fixture is provided such that the opposite members of the die set can be manipulated over reinforcing at said opening.

7. The method of claim 1, wherein reaching the clamping fixture across the edge includes manipulating the opposite members of the die set over reinforcing at the opening between the edge and the accessible area.

* * * * *